United States Patent [19]

Czelusniak, Jr.

[11] Patent Number: 4,637,329

[45] Date of Patent: Jan. 20, 1987

[54] TUFTING MACHINE WITH MODULAR CONSTRUCTED NEEDLE BARS

[75] Inventor: Paul A. Czelusniak, Jr., Eden, N.C.

[73] Assignee: Fieldcrest Mills, Inc., Eden, N.C.

[21] Appl. No.: 821,036

[22] Filed: Jan. 21, 1986

Related U.S. Application Data

[63] Continuation-in-part of Ser. No. 678,072, Dec. 4, 1984, Pat. No. 4,574,716.

[51] Int. Cl.[4] ..... D05C 15/00

[52] U.S. Cl. ..... 112/80.45

[58] Field of Search ..... 112/79 R

[56] References Cited

U.S. PATENT DOCUMENTS 3,485,195 12/1969 Torrence .
3,618,542 11/1971 Zocher .
4,092,838 6/1978 Gangi .
4,138,956 2/1979 Parsons .
4,157,690 6/1979 Lund et al. .
4,170,949 10/1979 Lund .
4,398,479 8/1983 Czelusniak, Jr. .
4,483,261 11/1984 Green et al. ..... 112/79 R

*Primary Examiner*—Ronald Feldbaum
*Attorney, Agent, or Firm*—Bell, Seltzer, Park & Gibson

[57] ABSTRACT

A needle bar of modular construction for use in a tufting machine wherein each of the modular units has a mounting bracket with a plurality of uniformly spaced apart tubes soldered thereto and each tube receives the shank of a tufting needle therein with fastener means penetrating the tubes for engaging and securing the tufting needles within the tubes.

10 Claims, 8 Drawing Figures

TUFTING MACHINE WITH MODULAR CONSTRUCTED NEEDLE BARS

This invention is a continuation-in-part of my copending application Ser. No. 678,072, filed Dec. 4, 1984, now U.S. Pat. No. 4,574,716.

This invention relates to tufting machines and more particularly to multi-needle bar tufting machines for the forming of pile tufted fabrics of a wide variety of patterns.

This invention is particularly applicable to shiftable and registrable needle bars of the type as disclosed in my earlier U.S. Pat. No. 4,398,479 wherein the needle bars are adapted to be shogged relative to each other for forming a wide variety of pattern effects and so that the needles of the respective bars may be registered with each other to form a single row of needles, all in alignment with each other during each active stroke of the needles in penetrating the base fabric and in the forming of the pile tufts thereon. My aforementioned U.S. Pat. No. 4,398,479 while disclosing several types of constructions of needle bars, presents a common problem that the instant invention is more particularly directed to overcoming. Specifically, it has been learned that it is not only tedious, time consuming and very expensive to attempt to form needle bars as disclosed in my aforementioned patent wherein holes have to be very carefully bored through the needle bars for receiving the needles therein, but also wherein errors in boring the holes are compounded with the result that the needles on the pairs of cooperating bars would not properly register with each other for forming a single row of transversely aligned needles.

Further, in my prior patent, in one embodiment different lengths of needles were utilized for the cooperating needle bars, and in another embodiment the needles were bent in an offset manner for accommodating being positioned in alignment with each other. In both constructions, modification had to be made to conventional linear needles which further added to the unfavorable economics in the manufacture of the needle bars.

In my copending application Ser. No. 678,072, now U.S. Pat. No. 4,574,716, a greatly improved needle bar construction is provided wherein the needle bar is formed of modular units, each of which comprises a simple mounting bracket with a plurality of identical tufting needles of conventional linear types suitably secured by soldering to the mounting bracket in uniformly spaced apart parallel relation with the eyes of the needles in alignment with each other. By this arrangement, detailed machining and boring of the needle bars and modification of the tufting needles is completely eliminated, as well as any compounding of machinery errors as in the past.

While this modular construction greatly facilitates the manufacture of needle bars, the replacement of a broken needle necessitates removal and replacement of solder to effect such needle replacement.

With the foregoing in mind, it is the primary object of this invention to provide a greatly improved needle bar construction of the modular type for facilitating the replacement of broken needles.

It is a more specific object of this invention to provide a modular construction of needle bars wherein each of the modular units comprises an elongate mounting bracket, a plurality of uniformly spaced apart parallel arranged relatively short tubes secured to such mounting bracket and transversely thereof, and wherein the tufting needles have their shanks positioned in such tubes and held therein by suitable fastener means so that in the event of breakage of any of the needles quick replacement of the damaged needle may readily be effected by removing the damaged needle from the tube and replacing the same with a new needle.

Some of the objects and advantages of the invention having been stated, others will appear as the description proceeds when taken in connection with the accompanying drawings, in which—

It will be understood that while this invention will now be described with particular reference to the accompanying drawings, in which a preferred embodiment of the present invention is set forth, it is contemplated that persons skilled in the applicable arts may modify the specific details to be described while using this particular invention. Accordingly, the description is to be understood as a broad teaching, directed to the persons skilled in the applicable arts.

Further, although the invention has been illustrated with particular application and utility to shiftable needle bars having registrable needles adapted to be moved into a single row as described in my previous U.S. Pat. No. 4,398,479, it will be understood that this invention may be applied to various other types of conventional needle bars for tufting machines.

Figure 1:
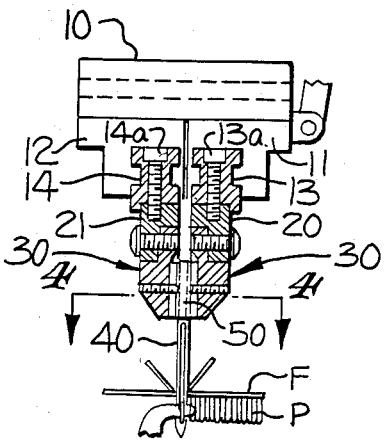
FIG. 1 is a fragmentary vertical sectional view through needle bars of a tufting machine embodying the present invention.
Figure 2:
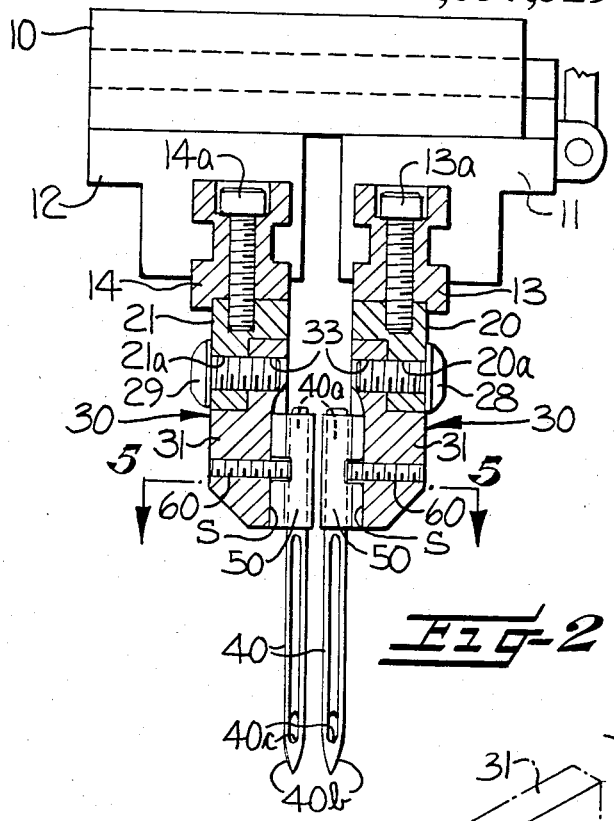
FIG. 2 is a view similar to FIG. 1 but, on a larger scale, illustrating the rows of needles out of registration with each other.

Referring now more particularly to the drawings, reference numeral 10 broadly indicates a supporting member suitably carried on a tufting machine and from which are supported needle bar carrier members 11 and 12 with member 11 being mounted for transverse horizontal sliding movement toward and away from carrier member 12 as best illustrated by comparing the position of carrier member 11 in FIG. 2 with that in FIG. 1 (note the spaced relation of the carrier members in FIG. 2). In turn supported from carrier members 11 and 12 are longitudinally slideable rail members 13 and 14 to the lower portions of which are suitably secured respective needle bars 20 and 21 as by fastener screws 13*a*, 14*a* respectively. Each of the needle bars 20, 21 have horizontally arranged holes 20*a*, 21*a* respectively for the purpose of mounting modular units 30 of tufting needles thereon. As illustrated, conventional threaded fastener screws 28, 29 pass through the holes 20*a*, 21*a* and into engagement with horizontal threaded bores 33 on the modular units to serve for effecting the mounting of the modular units 30 on the respective needle bars 20 and 21.

Each of the modular units 30 of tufting needles comprises a bracket 31 shown in the form of a body having a rear shoulder portion 32 for the purpose of cooperating with shoulder portion 20*b*, 21*b* of needle bars 20, 21 in the mounting of the modular units on the needle bars. It will also be noted that the cooperating relationship between shoulder portions 32 of the modular units 30 and the respective shoulder portions 20*b*, 21*b* facilitate the vertical aligning of the holes 33 with the respective threaded bores 20*a*, 21*a* of the needle bars.

Figure 3:
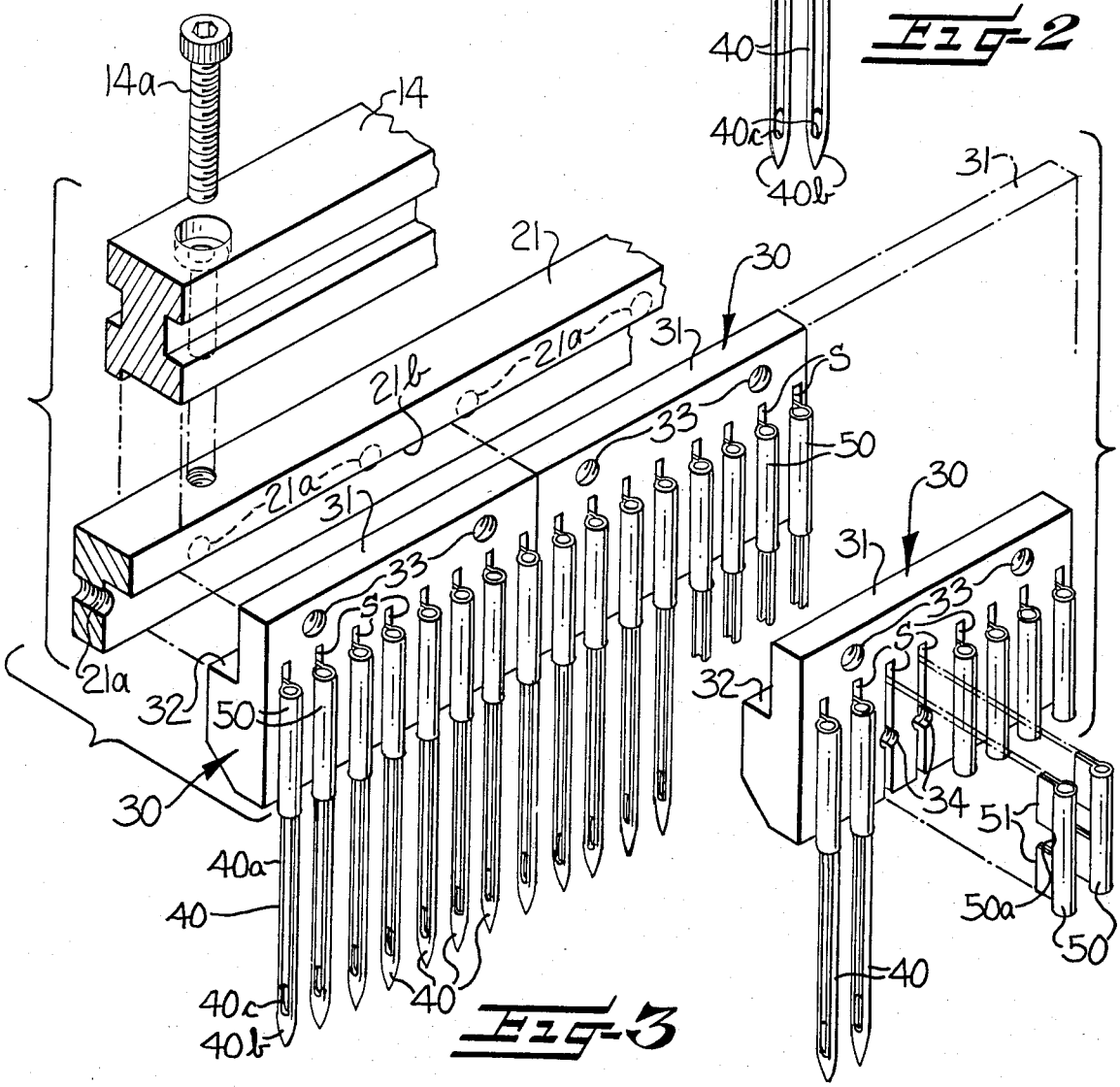
FIG. 3 is a fragmentary perspective view of one of the needle bars with parts broken away for illustrating the modular construction.
Figure 6:
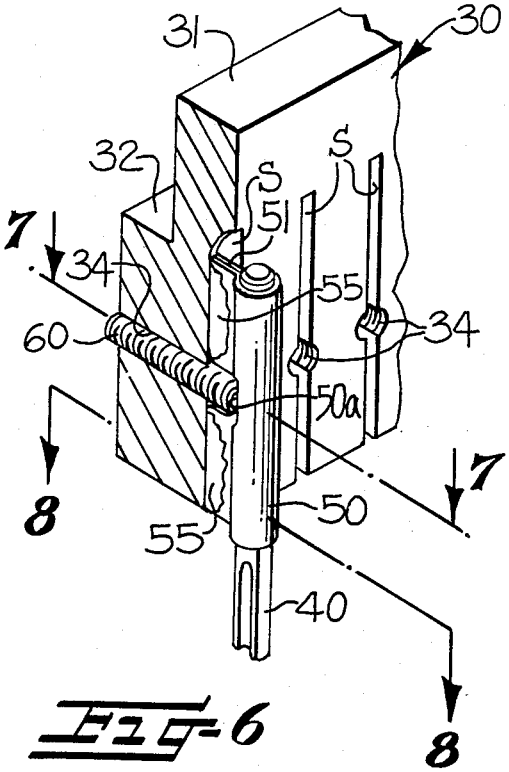
FIG. 6 is a fragmentary perspective view illustrating in greater detail the manner in which the needles are positioned and held in the modular units.
Figure 7:
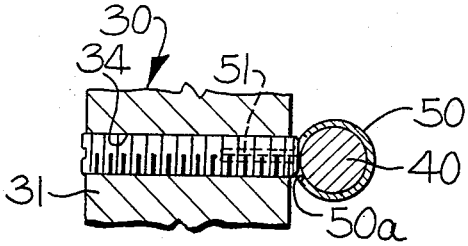
FIG. 7 is a fragmentary horizontal view taken along line 7—7 of FIG. 6 and on a somewhat larger scale.
Figure 8:
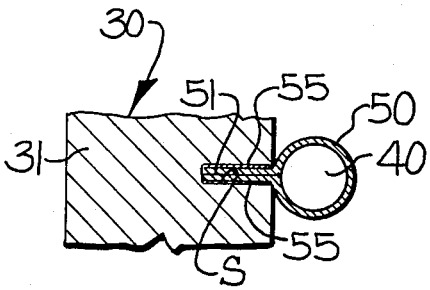
FIG. 8 is another detailed fragmentary view taken along line 8—8 of FIG. 6 also on a larger scale.

Mounted on the outer face of the bracket 31 are a plurality of tufting needles 40 which are positioned in uniformly spaced apart parallel relation with the eyes of the needles in aligned relation to each other. For obtaining and maintaining the uniform spaced apart relation of the needles 40, a plurality of relatively short needle shank receiving tubes 50 are provided on the face of the bracket. Tubes 50 are of thin-walled metal construction and preferably of such cross-section as to snugly receive the shanks of the tufting needles therein. The tubes 50 also have holes 50*a* in a medial rear portion thereof with flange portions 51 extending rearwardly from the periphery of the tubes along opposite sides of the holes 50*a* into slots S provided in bracket 31 across the face thereof. As best seen in FIGS. 6 through 8, the slots S extend transversely of the bracket 31 and have a sufficient depth so as to receive and accommodate tube flanges 51 therein. For fixedly securing the tubes 50 in the slots S, fastener means in the form of silver solder 55 is provided for engaging rear peripheral portions of the tubes 50 and the flanges 51 extending therefrom. As illustrated in FIG. 3, the flanges 51 are shown as being of bifurcated construction so as to accommodate the holes 50*a* in the middle of the rear portions of the tubes 50.

Tufting needle fastener screws 60 are provided for engaging the shank portion of the tufting needles 40 through the holes 50*a* and thus serve to secure the tufting needles within the tubes 50. It will be noted that each of the brackets 31 is provided with a suitable row of horizontal threaded bores 34 therein for accommodation of such tufting needle fasteners screws 60. It should also be noted that horizontal threaded bores 34, as best shown in FIGS. 3 and 6, are preferably positioned to extend through the thicker part of the bracket 31 about midway of the length of the slots S provided in the face of the bracket.

Each of the tufting needles 40 comprises a shank portion 40*a* and an opposing tapered end 40*b* having a transversely arranged yarn receiving eye 40*c* therein. It will be noted that a substantial portion of the shank portion 40*a* of each of the tufting needles 40 is snugly positioned within the tubes 50.

It will be noted as best shown in FIG. 3 that the modular units of tufting needles are arranged on the respective needle bars 20, 21 so that the mounting brackets 30 are in abutting relationship to facilitate providing uniform spacing of the tufting needles throughout the needle bar.

Figure 4:
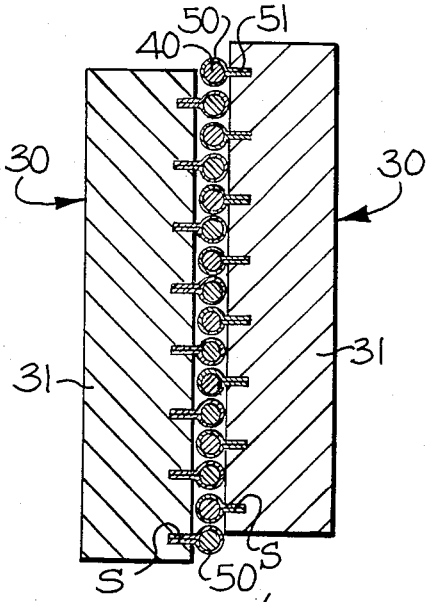
FIG. 4 is a horizontal sectional view taken along line 4—4 of FIG. 1 and on a larger scale.
Figure 5:
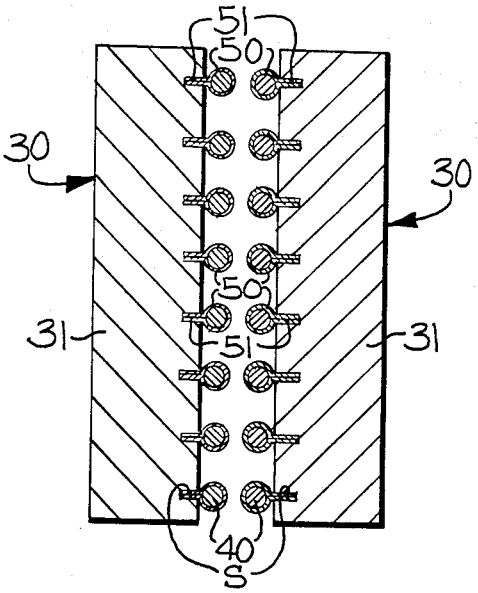
FIG. 5 is an enlarged horizontal sectional view taken along line 5—5 of FIG. 2.

It will be seen that through use of thin walled tubes 50 for carrying the tufting needles 40 on the brackets 30, the tufting needles may be positioned in very close relationship to each other so as to provide a needle bar construction of fine gauge, so as to make fabrics of fine gauge. As an example, the tufting needles 40 on each of the presently constructed prototype modular units 30 of this invention are positioned so as to be of a gauge of 5/16 inch, i.e. from point to point of the tufting needles. When the needle bars 20, 21 are in registration as shown in FIG. 4, the resulting gauge is 5/32 inch. It will now be noted by comparing FIGS. 4 and 5 that the space between the tufting needles on the respective needle bars is only slightly greater than the cross-sectional dimension of the shank of each of the tufting needles. Thus when the needle bars are positioned in registered alignment with each other as illustrated in FIGS. 1 and 4 preparatory to forming a row of pile loops P in the fabric F, it will be seen that a very fine density of tufted pile fabric can be manufactured.

While the instant invention permits a fine gauge tufting needle bar construction to be effected in a very efficient and precise manner, it should also be appreciated that the modular construction of the needle bars permits relatively easy maintenance in the event a tufting needle is damaged and needs to be replaced. If this occurs it is merely necessary to remove the broken needle from the tube 50 by loosening fastener screw 60 and then replacing the broken needle with a new needle 40. Alternatively, if several needles in one modular unit are damaged, the entire modular unit 30 may be removed simply by removing a pair of fasteners 28, 29 to then permit replacing the entire modular unit.

In the drawings and specification there has been set forth the preferred embodiment of the invention and, although specific terms are employed, they are used in a generic and descriptive sense only, and not for purposes of limitation, the scope of the invention being defined in the claims.

That which is claimed is:

1. A needle bar of modular construction for use in a tufting machine and comprising an elongate bar and a plurality of aligned modular needle bar units of tufting needles carried by said bar, each of said modular units comprising an elongate mounting bracket having a face, a plurality of uniformly spaced apart parallel arranged relatively short separate tubes for receiving tufting needles positioned on said mounting bracket transversely thereof and extending along the face of the bracket, means for securing said tubes to said mounting bracket, a plurality of tufting needles each having a shank and an opposing tapered end having a transverse yarn receiving eye therein, the shank of said needles being positioned within said tubes, fastener means carried by said mounting bracket for securing the tufting needles in a predetermined position within the tubes with eyes of the tufting needles in alignment with each other, and means cooperating with said mounting brackets of said modular units for mounting the modular units on said elongate bar with the eyes of the tufting needles of all of the modular units in alignment with each other and with all the needles in uniformly spaced apart parallel relation to each other.

2. A needle bar according to claim 1, wherein each of said tubes has a transverse opening therein and said fastener means penetrates the transverse openings in the tubes for engaging the shanks of the tufting needles positioned in the tubes.

3. A needle bar according to claim 1, wherein said tubes are of relatively thin-walled metal construction and said tufting needles are snugly received therein.

4. A needle bar according to claim 1, wherein said mounting bracket has spaced apart parallel grooves extending tranversely of the bracket, a flange is connected to and extends outwardly from the periphery of each of said tubes and parallel to the axis of the tube, and solder means engages said flanges for fixedly securing the same in said grooves to thus secure the tubes to the mounting bracket.

5. A needle bar of modular construction for use in a tufting machine and comprising an elongate bar and a plurality of aligned modular needle bar units of tufting needles carried by said bar, each of said modular units comprising an elongate mounting bracket having a face with a plurality of spaced parallel grooves extending transversely of the bracket along the face thereof, a plurality of uniformly spaced apart parallel arranged relatively short tubes for receiving tufting needles extending along the face of said mounting bracket transversely thereof, a flange connected to and extending outwardly from the periphery of each of said tubes and parallel to the axis of the tube, solder means engaging said flanges for fixedly securing the same in said grooves to thus secure the tubes to the mounting bracket, a plurality of tufting needles each having a shank and an opposing tapered end having a transverse yarn receiving eye therein, the shank of said needles being positioned within said tubes, said tubes having a transverse opening therein, fastener means carried by said mounting bracket and penetrating the transverse openings in said tubes for securing the tufting needles in a predetermined position within the tubes with eyes of the tufting needles in alignment with each other, and means cooperating with said mounting brackets of said modular units for mounting the modular units on said elongate bar with the eyes of the tufting needles of all of the modular units in alignment with each other and with all the needles in uniformly spaced apart parallel relation to each other.

6. A modular needle bar unit for the needles of a tufting machine wherein a plurality of such units may be mounted on a shiftable needle bar for use in the tufting machine, each of the modular units comprising an elongate mounting bracket having a face, a plurality of uniformly spaced apart parallel arranged separate tubes for receiving tufting needles positioned on said mounting bracket and extending transversely thereof along the face thereof, means for securing said tubes to said mounting bracket, a plurality of tufting needles each having a shank and an opposing tapered end having a transverse yarn receiving eye therein, the shanks of said tufting needles being positioned within said tubes, and fastener means carried by said mounting bracket for securing the shanks of the tufting needles within said tubes in a predetermined position with the eyes of the tufting needles arranged in alignment with each other.

7. A needle bar according to claim 6, wherein each of said tubes has a transverse opening therein and said fastener means penetrates the transverse openings in the tubes for engaging the shanks of the tufting needles therein.

8. A needle bar according to claim 6, wherein said tubes are of relatively thin-walled metal construction and said tufting needles are snugly received therein.

9. A needle bar according to claim 6, wherein said mounting bracket has spaced apart parallel grooves extending tranversely of the bracket, a flange is connected to and extends outwardly from the periphery of each of said tubes and parallel to the axis of the tube, and solder means engages said flanges for fixedly securing the same in said grooves to thus secure the tubes to the mounting bracket.

10. A modular needle bar unit for the needles of a tufting machine wherein a plurality of such units may be mounted on a shiftable needle bar for use in the tufting machine, each of the modular units comprising an elongate mounting bracket having a face with a plurality of spaced parallel grooves extending transversely of the bracket along the face thereof, a plurality of uniformly spaced apart parallel arranged relatively short tubes for receiving tufting needles extending along the face of said mounting bracket transversely thereof, a flange connected to and extending outwardly from the periphery of each of said tubes and parallel to the axis of the tube, solder means engaging said flanges for fixedly securing the same in said grooves to thus secure the tubes to the mounting bracket, a plurality of tufting needles each having a shank and an opposing tapered end having a transverse yarn receiving eye therein, the shank of said needles being positioned within said tubes, said tubes having a transverse opening therein, fastener means carried by said mounting bracket and penetrating the transverse openings in said tubes for securing the tufting needles in a predetermined position within the tubes with eyes of the tufting needles in alignment with each other.

* * * * *